US006250002B1

(12) United States Patent
Wittenberg

(10) Patent No.: US 6,250,002 B1
(45) Date of Patent: Jun. 26, 2001

(54) VISUALLY SYMMETRIC REMOVABLE LOW PROTRUSION TENSIONED SIGN DISPLAY SYSTEM

(76) Inventor: Ron Leo Wittenberg, 17212 N. Scottsdale Rd., #2407, Scottsdale, AZ (US) 85255

( * ) Notice: Subject to any disclaimer, the term of this patent is extended or adjusted under 35 U.S.C. 154(b) by 0 days.

(21) Appl. No.: 09/305,861

(22) Filed: May 5, 1999

Related U.S. Application Data

(63) Continuation-in-part of application No. PCT/US98/11447, filed on Jun. 1, 1998, and a continuation-in-part of application No. 08/868,624, filed on Jul. 4, 1997, now abandoned.

(51) Int. Cl.[7] ..... G09F 17/00
(52) U.S. Cl. ..... 40/603; 40/590; 160/378
(58) Field of Search ..... 40/590, 603, 604; 160/328, 378; 38/102.1, 102.91

(56) References Cited

U.S. PATENT DOCUMENTS

| | | | | |
|---|---|---|---|---|
| 2,554,542 | * | 5/1951 | Rust et al. | 160/328 |
| 2,632,507 | * | 3/1953 | Ewing | 160/328 |
| 3,273,497 | * | 9/1966 | Rosema et al. | 160/378 X |
| 4,356,648 | | 11/1982 | Beaulieu | 40/783 |
| 4,404,962 | * | 9/1983 | Zinn et al. | 160/378 X |
| 4,580,361 | | 4/1986 | Hillstrom et al. | 40/603 |
| 4,757,854 | * | 7/1988 | Rippberger | 160/378 X |
| 5,046,545 | | 9/1991 | Loomis et al. | 160/328 X |
| 5,239,765 | | 8/1993 | Opdahl | 40/590 X |
| 5,255,466 | | 10/1993 | Snyder | 40/603 |
| 5,301,447 | | 4/1994 | Lotter et al. | 160/328 X |
| 5,373,655 | | 12/1994 | Suzuki | 40/603 |
| 5,408,770 | | 4/1995 | Suzuki | 40/603 X |
| 5,555,659 | | 9/1996 | Hade | 40/604 |
| 5,588,236 | | 12/1996 | Suzuki | 40/604 X |
| 5,657,566 | | 8/1997 | Key | 40/590 |

* cited by examiner

*Primary Examiner*—Brian K. Green
(74) *Attorney, Agent, or Firm*—Christensen O'Connor Johnson Kindness PLLC

(57) ABSTRACT

A specially engineered, low protrusion, visually symmetric small footprint system of mounting advertising displays to vehicles, such as trucks, tractor trailers, and vans, providing upward/downward adjustability, ease of frame removal and remounting, and over-center tensioning by means of specially designed rails which are attached to the surface of the vehicle. The rails are reversibly fastened to the surface of the vehicle, and can be easily and repeatedly removed and refastened in a short time. This is effected by sinking threaded screw seats into the wall on which the sign frame is mounted, providing permanent holes into which can be repeatedly screwed into and unscrewed from, the low protrusion screws which hold the sign frame to the wall. The hardware residue, after removal of the frame, is barely visible, with a very small footprint, being simply the protruding rims of the threaded screw seats. The entire system, when loaded with signage, and tensioned, protrudes very slightly from the surface of the vehicle, capitalizing on the total width tolerances to within which large trucks and tractor trailers are constructed, and designed not to increase such width beyond applicable regulatory maximum when fully operational.

18 Claims, 13 Drawing Sheets

VISUALLY SYMMETRIC REMOVABLE LOW PROTRUSION TENSIONED SIGN DISPLAY SYSTEM

CROSS REFERENCE TO RELATED APPLICATIONS

This application is a continuation-in-part of prior U.S. application Ser. No. 08/868,624, field on Jul. 4, 1997, now abandoned, and is a continuation-in-part of prior PCT application Ser. No. PCT/US98/11447 filed Jun. 1, 1998.

BACKGROUND OF THE INVENTION

This invention relates to a visually symmetric, low protrusion removable system or process for mounting flexible, easily replaceable, tensioned advertising displays on to the side of a vehicle, such as a truck, tractor trailer, or van. This invention also relates to a visually symmetric, low protrusion, removable system or process for mounting flexible easily replaceable, tensioned advertising displays on fixed billboards of various sizes.

There have been developed a number of methods for displaying advertising signage on the side of moving vehicles. Given the increased mobility of the public, and the growing unsatisfied demand for fixed roadside signage, the mobile billboard, achieved by mounting advertising art to the side of a transport vehicle, is becoming ever more common, and ever more practical, given advances in the technology of printing such advertising art, allowing better color quality, as well as much greater pixel resolutions. Taken together, these factors now make mobile, lateral surface of transport vehicle, advertising a higher quality and more sought after mode of commercial publicity than ever before with the development of the science of mobile commercial publicity production, one would expect a corresponding development and sophistication in the technology of mounting said media to their substrate, the lateral sides of transport vehicles. This invention is a new step in said development and sophistication.

There are a number of constraining factors in designing a mobile advertising mounting system, some regulatory, others aesthetic, some physical. Firstly, there exist federal as well as state transportation regulations restricting the width of transport vehicles at an upper limit. Secondly, transport advertising is most often procured by leasing the use of a carrier's fleet for such purpose. The fleet owner is inclined to lease to the advertising broker whose system impacts the least on the fleet's vehicles, in terms of time required for initial setup of the system, turnaround time for installation/replacement of a particular image, and complexity of the permanent hardware attached to the vehicle. Finally, in order to maintain the planar aspect of the sign, which is critical to readability from afar, the current industry practice is to apply tension to the signage. This has been accomplished in a variety of ways, such as the systems described in U.S. Pat. Nos. 5,239,765, and 5,507,109. The first of these two systems relies on a series of anchors placed along the top and bottom of the lateral sides of the vehicle. A flat rectangular rod has the edges of the signage wrapped around it on the top and bottom edges of the sign, and this wrapping is held by the rows of anchors. The series of anchors method presents obvious difficulties as far as bringing the individual anchors within the top or bottom row into perfect linear alignment, and there are also issues of significant protrusion from the side of the vehicle, using this system, which may violate state and federal regulatory restrictions. Additionally, this system of U.S. Pat. No. 5,239,765 has no mechanism to prevent the signage material acting as an airfoil, billowing and tending to pull away from the vehicle, or, at the very least, assuming a convex shape, thus distorting the image. This system further has no vertical or lateral adjustibility to account for variation in manufacture of the signage material.

U.S. Pat. No. 5,507,109 solves some of the problems with the system described in the earlier patent, yet it discloses a system that is visually asymmetric as well as possessing a much larger footprint. This implementation also requires a nonuniform as to the various edges method of attaching a structural element to the signage, namely using a rod in a pocket of the sign on the leading and top edges, and holes ringed by grommets on reinforced flaps which must be sewn to the trailing and bottom edges of the sign, thus decreasing the available area of the sign that can be used for displaying the image; bungee cords, referred to therein as "shock cords", are attached to the grommets, or eyelets, as therein referred to, and the shock cords are attached to the truck wall by means of S hooks connected to either flanges which the patent claims "run along the bottom and top edges of the sides of most trailers", or if they are not present, then it is suggested that other structures, such as holes drilled in the sides of the trailer, may suffice. However, many truck and trailer owners would vehemently object to holes large enough to accommodate said S hooks being drilled in their vehicle sides. This system anchors the leading and top edges of the sign by what appears to be a standard awning anchor, and tensions the bottom and trailing edge of the signage by said bungee cords and S hook fastening process. The tension along the vertical axis of the sign is thus not uniform along said vertical axis, and may tend to create wavelike ripples in the signage; additionally, being non-rigid, the S hooks will tend to have a time varying tension component perpendicular to the sign, ultimately being a complex function of the terrain along which the vehicle travels, the natural frequencies and other vibratory properties of the vehicle siding and other internal vehicular components, and the ambient air, thus creating localized hills and valleys in the surface of the sign, distorting the image, and diminishing readability. It is not discussed in U.S. Pat. No. 5,507,109 exactly how the leading edge and top edge tracks are in fact affixed to the trailer siding, nor is it disclosed whether the affixing mechanism is a permanent fixture of the trailer, or how much it impacts the trailer siding in terms of creating moisture pathways or how many fasteners per unit length are required to adequately affix the said tracks. Additionally, the system disclosed in U.S. Pat. No. 5,507,109 requires attaching additional reinforced strips of sign material to the signage, where such additional reinforced strips contain the eyelets through which the trailing edge shock cord is threaded. The requirement of the eyelets as the means for attaching the sign to the substrate thus reduces the area of the signage available for the printed display or artwork. Finally, the system of U.S. Pat. No. 5,507,109 requires a fixed rod to hold the signage; the rod is inserted in a pocket in the signage material. This requires additional insertion time at the installation site, which can be substantial, or if pre inserted, it precludes rolling up the signage for storage and transport, inasmuch as a vertical and a horizontal fixed rod force the signage into a plane.

A further problem with the shock cord method is functional, the rubber from which shock cords are made changes over time with exposure to the elements, especially heat and UV radiation from sunlight, which is increasing yearly. The UV exposure causes cracking, loss of elasticity, and ultimately breakage, of the rubber shock cords. This reduces the tensions that they can be put under, thus decreasing their efficacy for the modem low stretch vinyl signage, which needs to be placed under tension so as to maintain a planar quality on a moving vehicle.

What is desired is a visually symmetric, simpler, durable, comprised of a small number of parts, and specially engineered to impact the truck or trailer at a minimum in terms of fasteners per foot required to the truck or trailer siding, as well as insulating the truck or trailer interior form moisture, system of attaching signage to a transport vehicle. Such a system should keep the signage material as planar as possible, and not introduce a vacuum or partial vacuum underneath it, or cause air pockets to form underneath it either, at any point along the sign. Such a system would have its framing removable, and insure protrusion from the lateral surface of the vehicle low enough to comply with all regulatory maximum vehicle width specifications. Once the framing is removed the visible residue should be at an absolute minimum, and the framing should be capable of replacement and removal at will, and in a short, less than half-hour, time frame. The system would also allow for insertion of the line by which the edges of the sign are anchored to the substrate to be flexible, allowing for pre-insertion at the time of manufacture, and easy transportation.

BRIEF SUMMARY OF THE INVENTION

This invention is directed toward providing an improved method of displaying flexible signage. The signage display mechanism of the present invention provides a display frame with a top edge and leading edge, as well as a bottom edge and a trailing edge. Inside the frame is mounted a PVC, or similar material, which can also be reinforced, sign or display, carrying advertising or other printed matter for public display. The sign material has a small diameter bolt rope inserted into a pocket around its perimeter, and this bolt rope is thermally welded in place. Metallic or other similar material rails provide the anchoring top and leading edge frame into the approximately cylindrical groove of which the edge of the sign pocket, where the bolt rope is inside, is inserted. The bottom and trailing edges of the frame are composed of two parts; the first is the identical rail used on the top and leading edge serving as an anchor, with an additional over-center tensioning latch rail into the approximately cylindrical groove of which the bottom and trailing edge pockets of the sign, where the bolt rope is are inserted. The over-center latch rail is then pushed downward, so as to lie in the same vertical pane as the top and leading edge rails, causing the sign to be tensioned tautly in a vertical plane slightly in a plane in front of the plane formed by the rails and the latch rails. The signage, when inserted, and when the over-center latch rail dosed, appears symmetric about axes both vertical and horizontal, crossing at the center of the signage material, and is very nearly planar, providing an undistorted view of the artwork printed thereon. To accommodate differences in manufacture of various signs or display images, the rail used for the top and leading edges of the frame, and also as the anchor rail for the bottom and trailing edges of the frame, has two horizontal rows of fastening holes, placed vertically one above the other, and spaced a fixed distance one from the other, through which the row of fastening screws can be fed, allowing upward/downward as well as lateral adjustibility to accommodate for manufacturing variation of the signage or display material.

Two enhancements to the invention are also available, and their implementation will generally depend on cost/benefit considerations. In some circumstances, it may be desirable to affix a flexible yet strong groove insertion device to the perimeter of the sign, and dispense with the bolt rope in the sign pocket configuration. Additionally, where more upward/downward and lateral adjustability, as to the spacing between pairs of anchor rails, and thus, the sign edges is desired, to accommodate variations in sign sizes or to vary the tension in a given sign over its useful life, the two rows of fastening holes in the anchor rails can be replaced with (rectangular) slots, and identical sized slots are cut into the crossover rails, thus allowing more continuous upward/downward (in the case of the top and bottom frame rails) as well as lateral (in the case of the front and trailing frame rails) adjustability within the range of the slot dimension. In this latter configuration, the screws are screwed in over special cam washers, which are used to hold certain positions in the distance range, in the case of the anchor rails, and simple washers, to space as well as hold the screw in place (over the wider slot) in the case of the crossover rail.

BREIF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 1A–1C provide a head-on view of the signage system fully installed and tensioned on the side of a truck. FIG. 1A shows the entire system, and FIGS. 1B and 1C, respectively, show expanded views of the top right and bottom left corners of the sign and the frame rails, wherein the end cap can be seen as well.

Figure 9C:
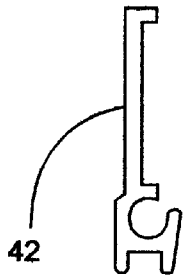
Figure 9A:
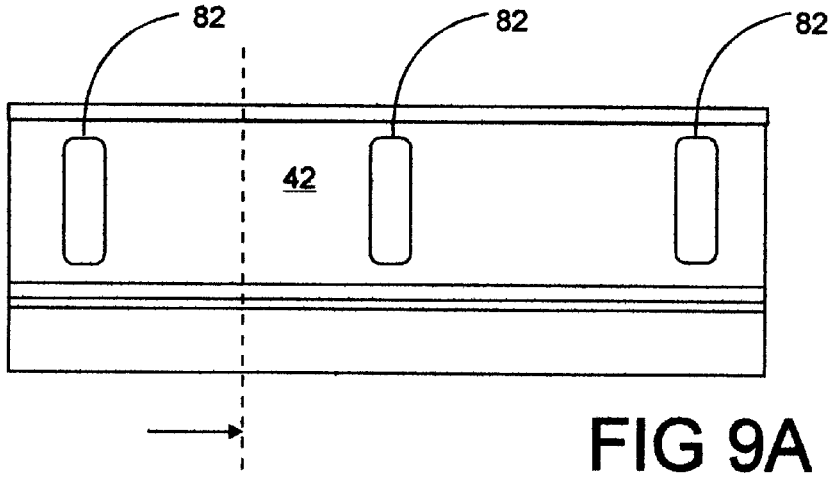
Figure 9D:
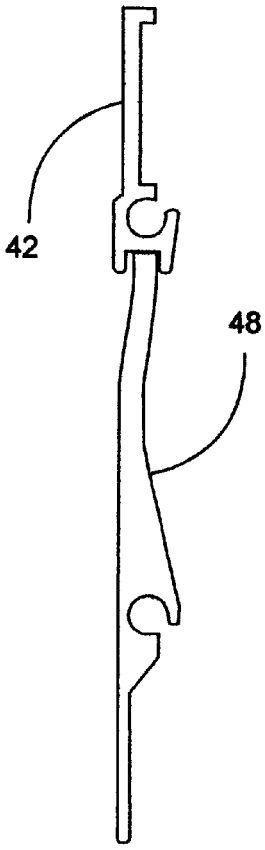
Figure 9B:
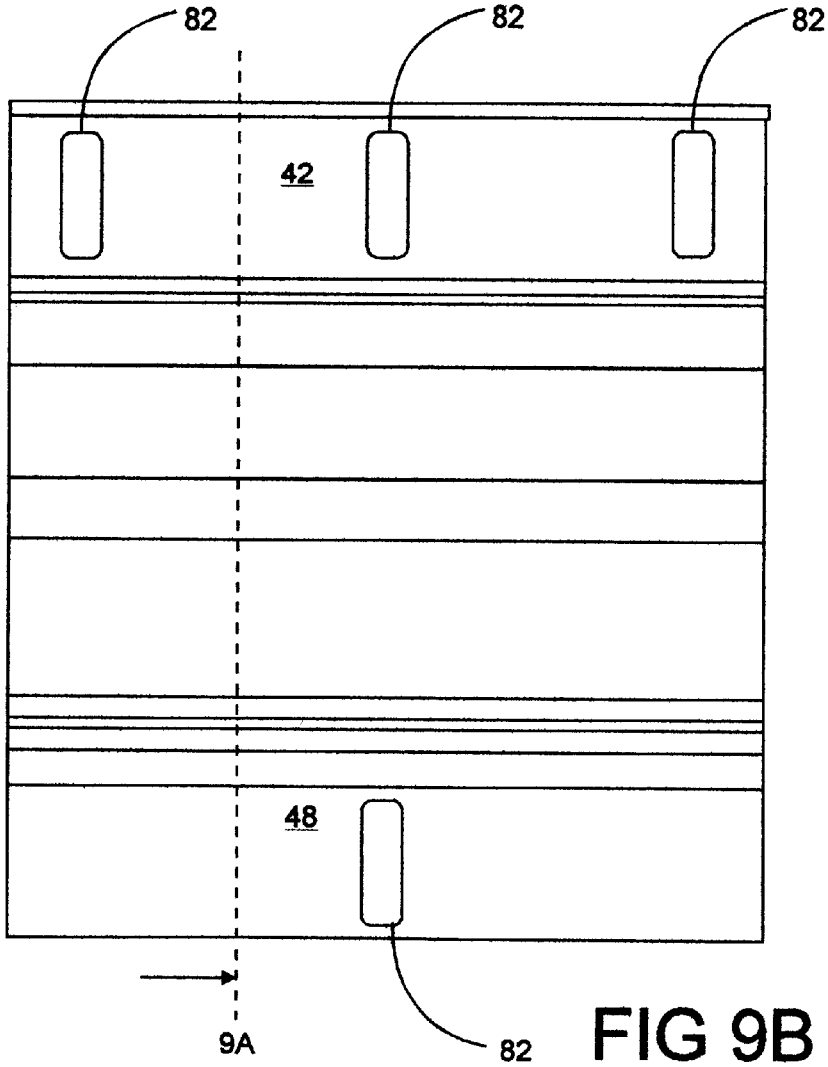

FIGS. 9A and 9B are close-up views of an alternative anchor rail/crossover latch rail combination wherein the positioning of the mounting rails relative to the substrate and the fixed position of the embedded screw seats is given a wide range of adjustability by means of a rectangular slot in the mounting rails and lever arm and a cam washer system allowing each mounting rail to be positioned at varying points within a certain range of distances relative to the embedded screw seats in the substrate.

FIGS. 9C and 9D are respective end views of FIGS. 9A and 9B.

Figure 10D:
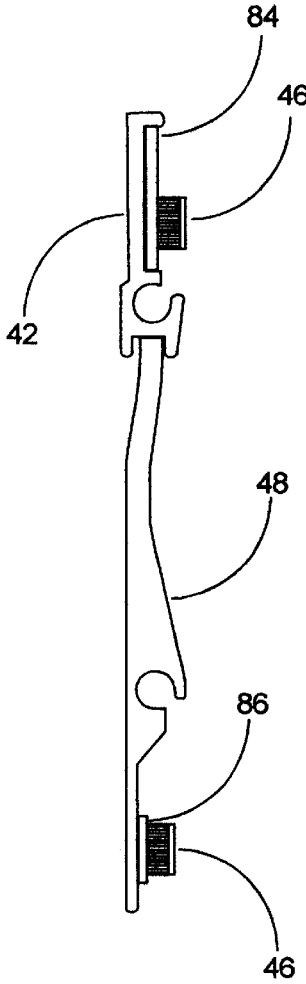
Figure 10A:
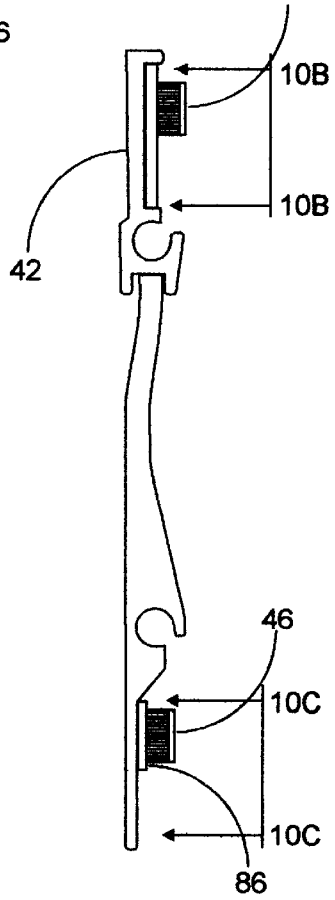
Figure 10B:
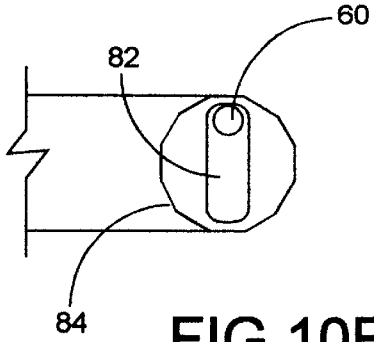
Figure 10C:
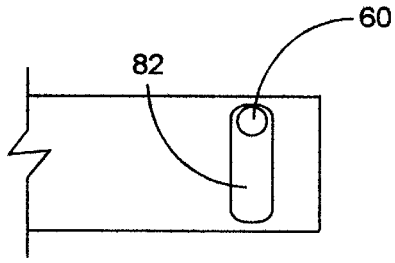

FIG. 10A is the side view of the present invention similar to FIG. 9D, with the attachment screws for attaching the anchor rail/cross-over latch rail in one extreme position;

FIG. 10B is a partial front view of FIG. 10A, taken substantially along lines 10B—10B thereof;

FIG. 10C is a partial front view of FIG. 10A, taken substantially along lines 10C—10C thereof; and FIG. 10D is a side view of the present invention similar to of FIG. 10A, wherein the mounting screws are positioned in opposite extreme positions relative to the slots formed in the anchor rail/cross-over latch rail.

DETAILED DESCRIPTION OF THE INVENTION

Figure 1A:
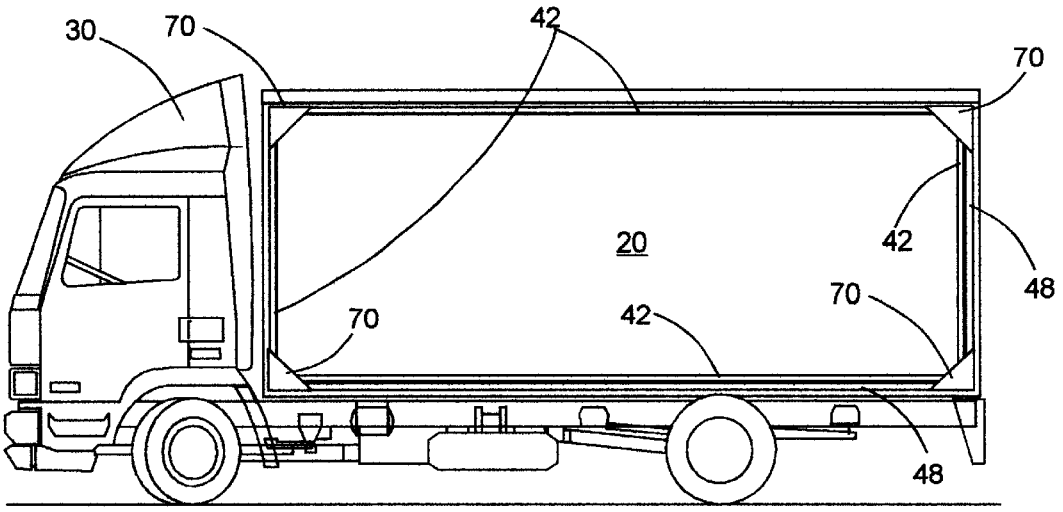
Figure 1B:
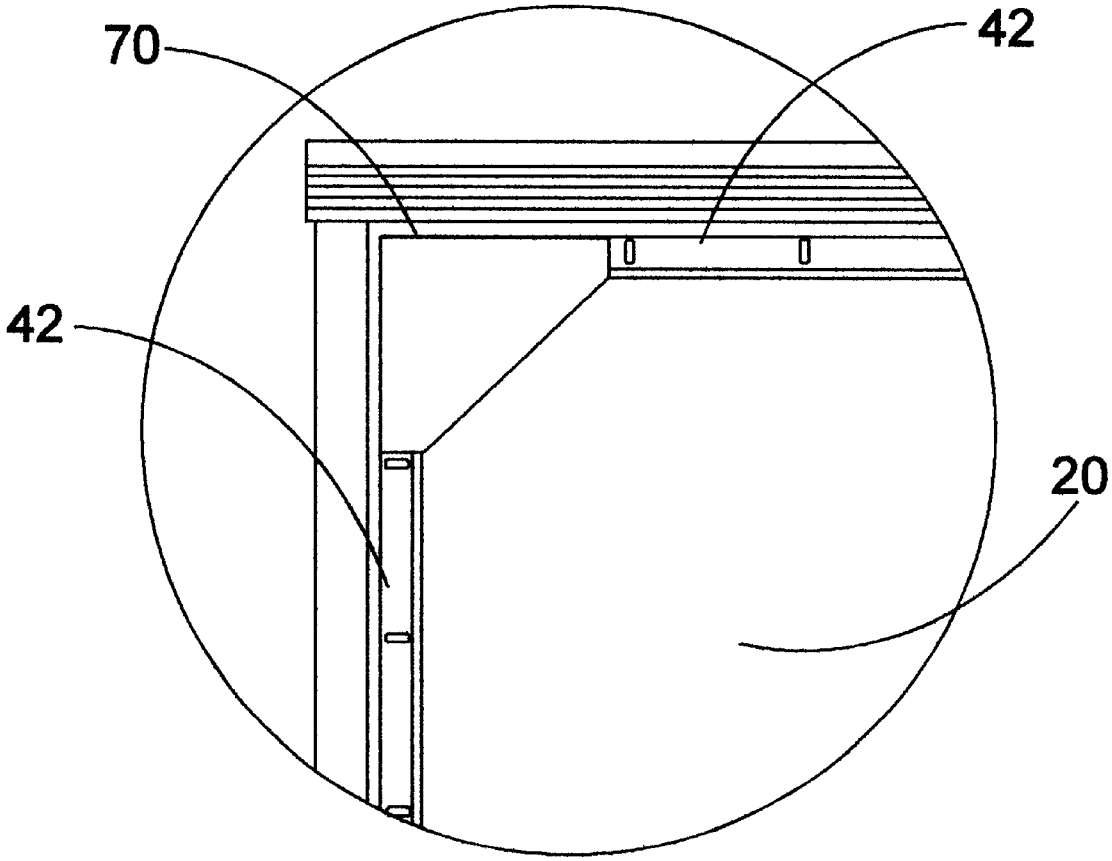
Figure 1C:
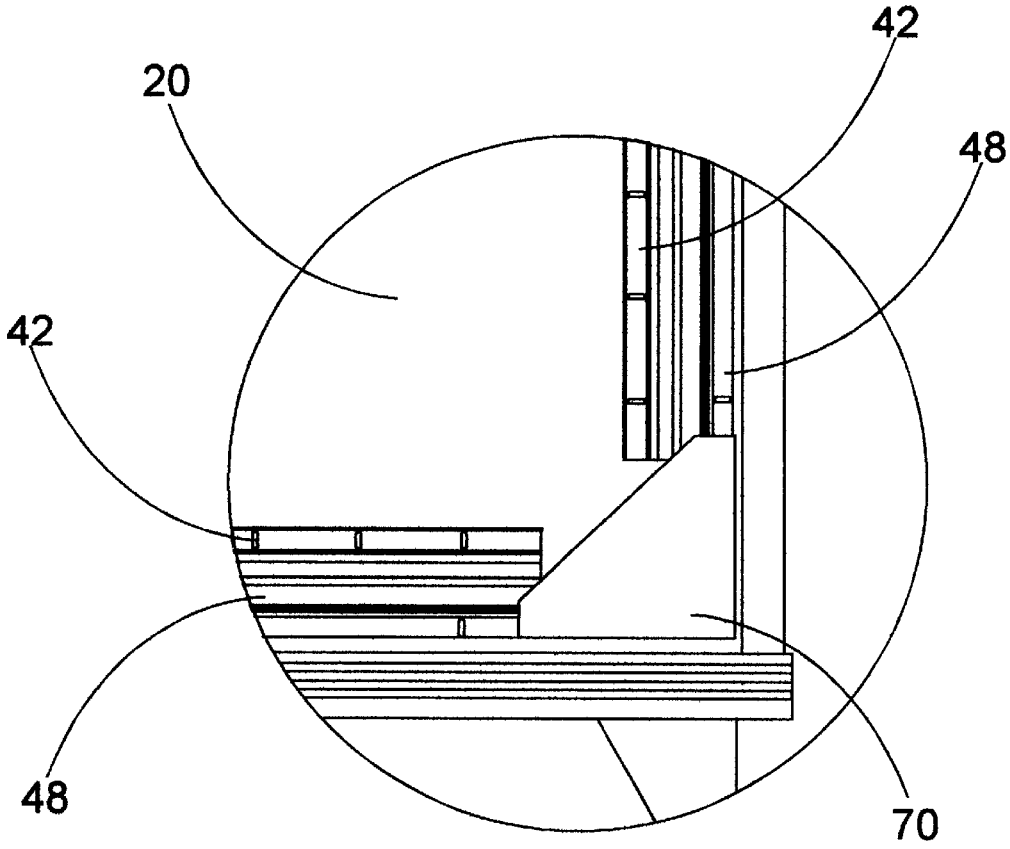
Figure 2:
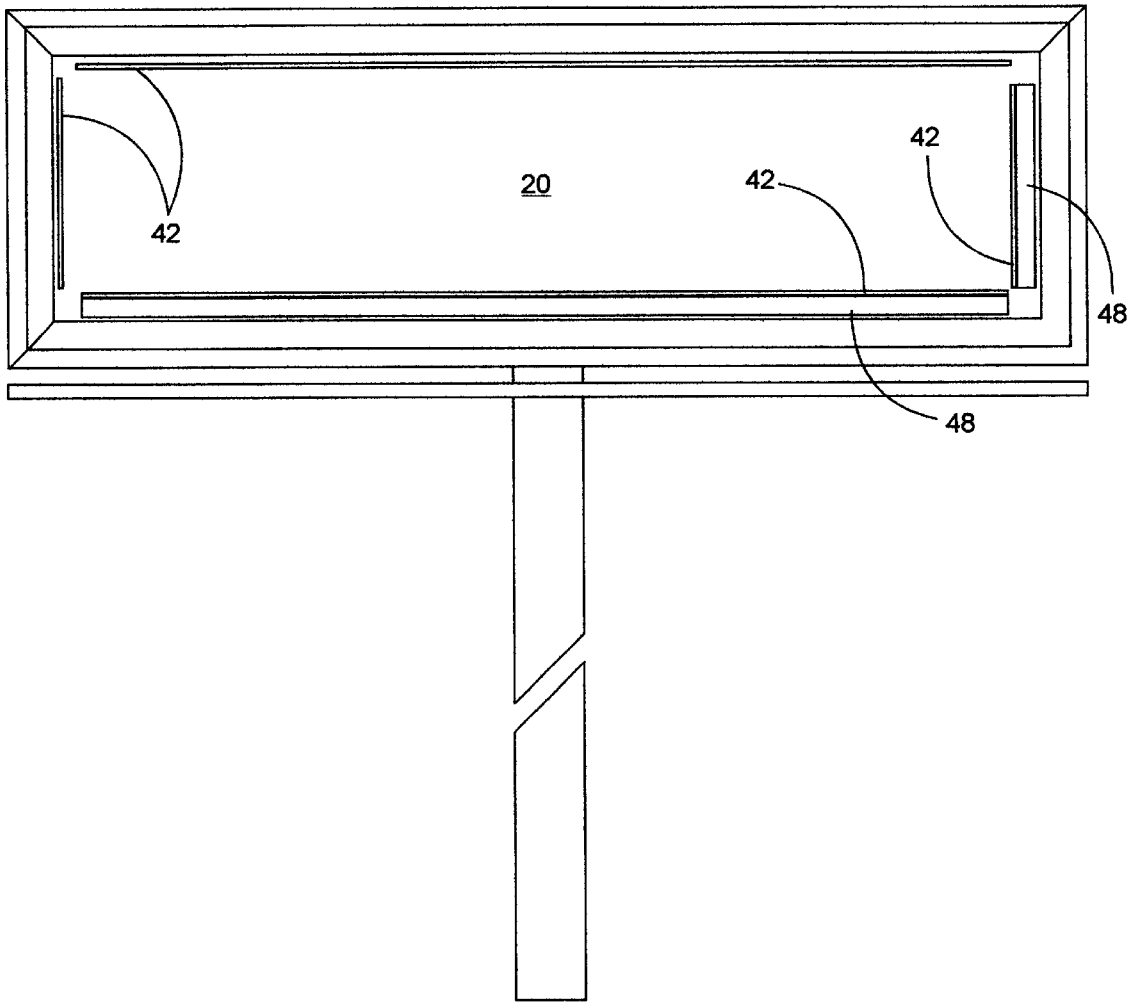
FIG. 2 is a head-on view of the signage system fully installed and tensioned on a fixed billboard.

Referring to FIG. 1, a typical embodiment of the signage display system of the present invention is shown. A flexible sign 20 is held in place on the side of a transport vehicle 30 by being inserted into cylindrical grooves which run along the four edges of the frame, which is composed of an anchor rail 42 for the top and leading edges, and an anchor rail 42 holding a cross-over latch rail 48 for the bottom and trailing edges. Since the frame rails do not form a complete rectangle, but rather a rectangle with four cut off corners, to allow the insertion of the sign, plastic end caps 62 cover the corners for visual symmetry and preclusion of flapping in the wind of the sign corners. The system is shown in FIG. 2 in another embodiment as installed on a fixed billboard type sign. In order to prevent wind from entering behind the sign at the leading edge and pressurizing the sign, billowing it in a convex shape away from the vehicle, tape putty is placed between the back side of the forward rail and the vehicle body wall. The thickness of the putty varies with the texture of the vehicle wall. In this implementation the frame rails, both the anchor rail and the crossover latch rail are manufactured of high strength aluminum, in other implementations they can be made of materials with similar functional properties.

Figure 3A:
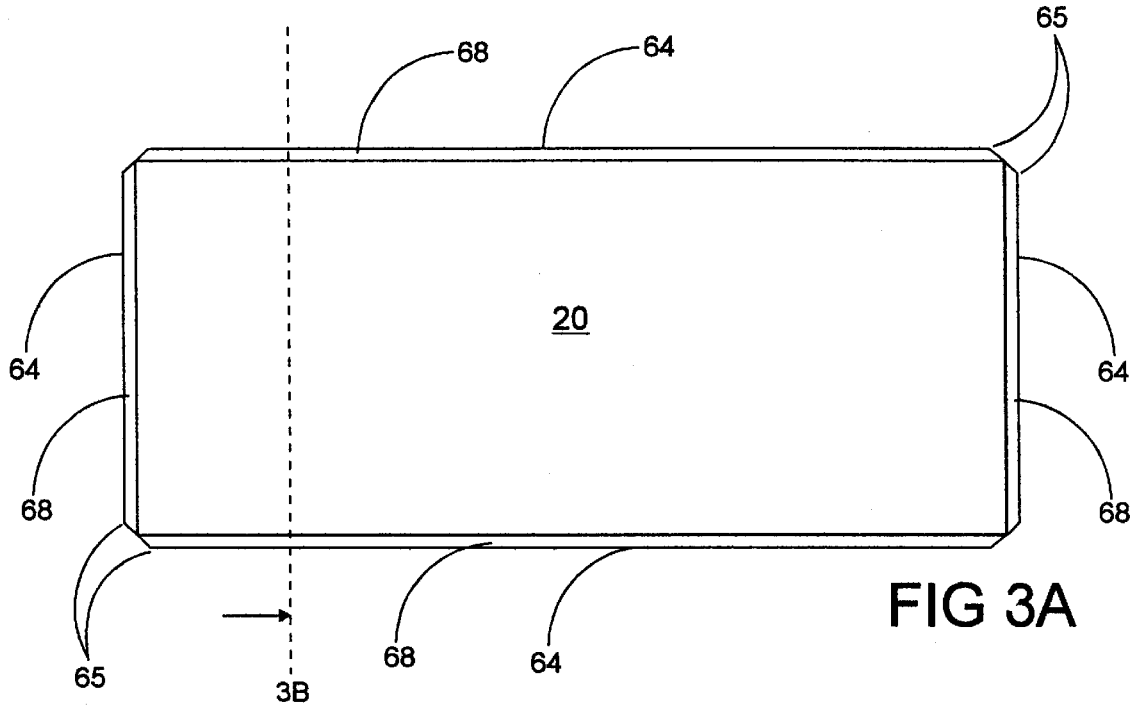
FIG. 3A shows the sign itself, with the pockets running the length of its four edges, as well as a sectional view of an edge of the sign showing the pocket and the seam which creates the pocket.
Figure 3B:
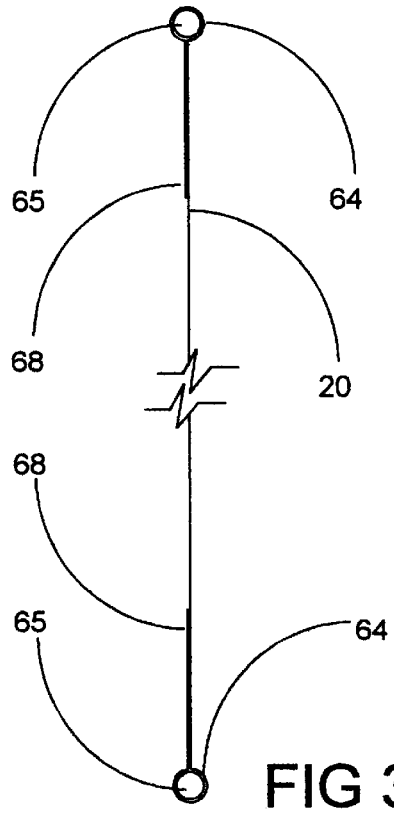
FIG. 3B is a sectional view taken along the section line 3B of FIG. 3A.

FIG. 3A shows the sign 20 and its four edges where the sign material has been folded over to create a pocket 64, wherein is set a nylon bolt rope. The seam creating the pocket, as well as the bolt rope itself in the pocket, are all RF, or thermally welded together and in place for a tight and secure hold. FIG. 3B is a sectional view of an edge of the sign, showing the proportions of the pocket seam 68 in relation to the pocket 64 and the bolt rope 65.

Unlike prior art, the bolt rope in this embodiment is flexible, made of a nylon line of small diameter. The nylon line does not need to be inserted into an already formed sign pocket; rather, the line insertion and the pocket formation are done simultaneously. The line is simply laid down in place, the signage or display material folded over it, forming the pocket 64, and all pieces are RF (radio frequency) or thermally welded into place. This embodiment is thus flexible, allowing for attachment of the bolt rope at the manufacture site, rolling up of the signage for transport, and unrolling of said signage at the installation site, for quick and easy field installation.

Figure 4A:
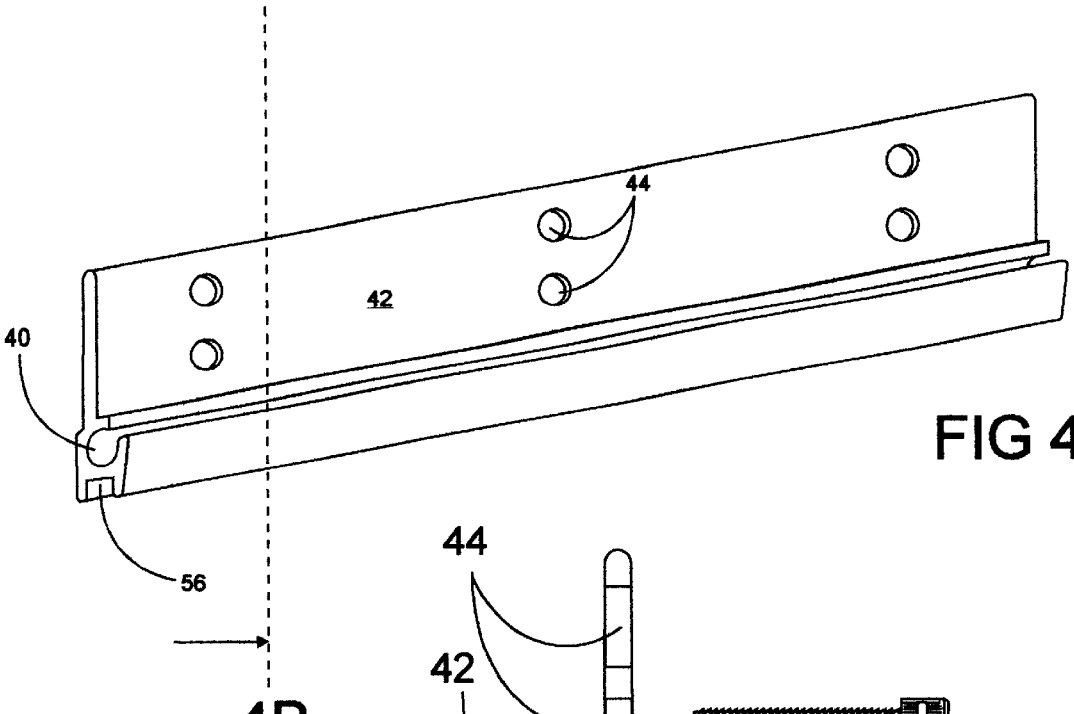
FIGS. 4A and 4B show a partial view and cross-sectional view of the anchor rail.
Figure 4B:
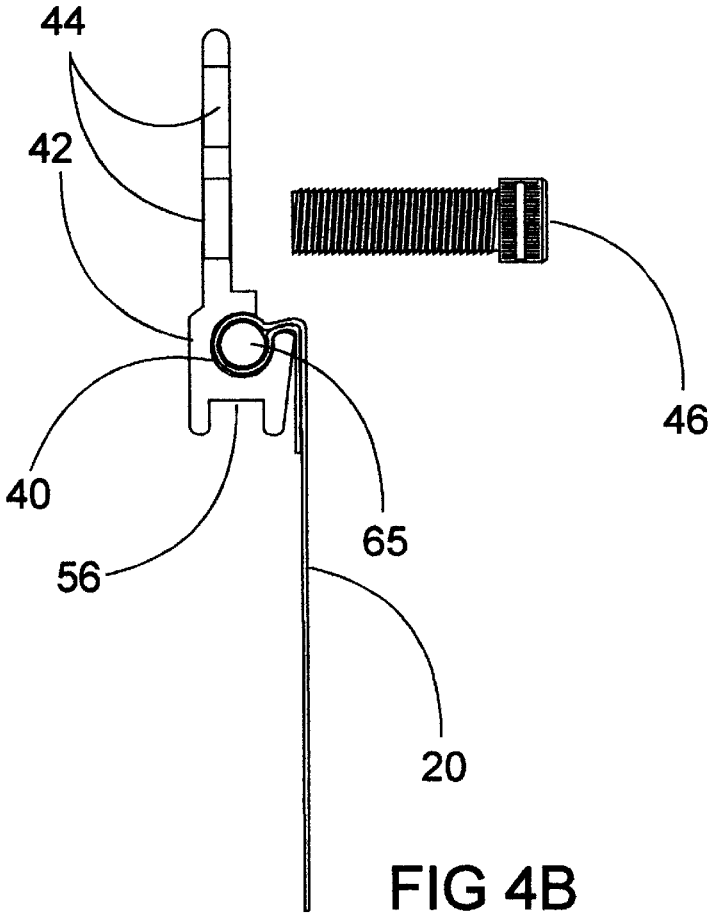

FIGS. 4A and 4B indicate in detail how the sign is held on the top and leading edges by the top or leading edge of the anchor rail 42, with its cylindrical groove 40 on the top end, where the sign is inserted and held via the bolt rope 65 (FIG. 48), and the pivot slot 56 on the bottom end, into which the pivot edge of the crossover rail fits when the bottom or trailing edge of the sign is tensioned. This implementation is specially engineered to use the same anchor rail for two functions. The anchor rail secures or anchors the top and leading edges of the sign or display, and also anchors the cross-over rail latch and provides it a pivot slot over which it pivots as it tensions the sign on the bottom and trailing edges. Using the anchor rail for two functions thus reduces the part count and the costs associated with manufacture, quality control, and inventory. Fewer parts are thus needed to be understood for the proper installation and maintenance of the system. Screws 46 can be placed in either row of screw holes 44, as needed, to accommodate variations in actual sign height, without having to remount fasteners to the vehicular wall, thus allowing vertical adjustibility. The screws 46 have a 360-degree sealing and locking pad about the middle of the thread length to seal out moisture and prevent loosening due to vibration. Screws are fed through the screw holes 44 into the threaded screw seats, which remain in the vehicle or billboard wall. The screws have a low protrusion from the plane of the substrate, thus allowing the entire design to fit within the tolerances to which transport vehicles are manufactured vis-à-vis the regulatory maximum transport vehicle width, thus insuring compliance with said regulations by the fleet owner.

Figure 5A:
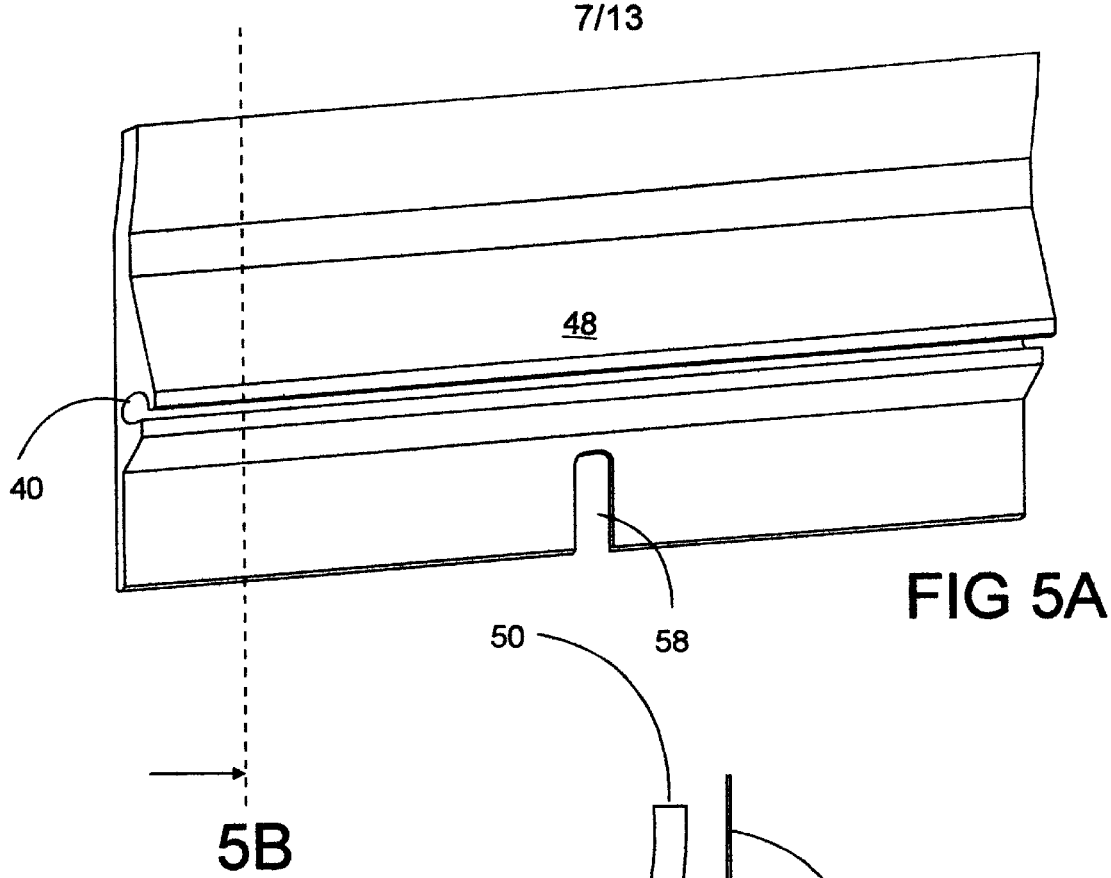
FIG. 5A is a corresponding partial view of the crossover latch rail, showing a partial length section and a cross-sectional view.
Figure 5B:
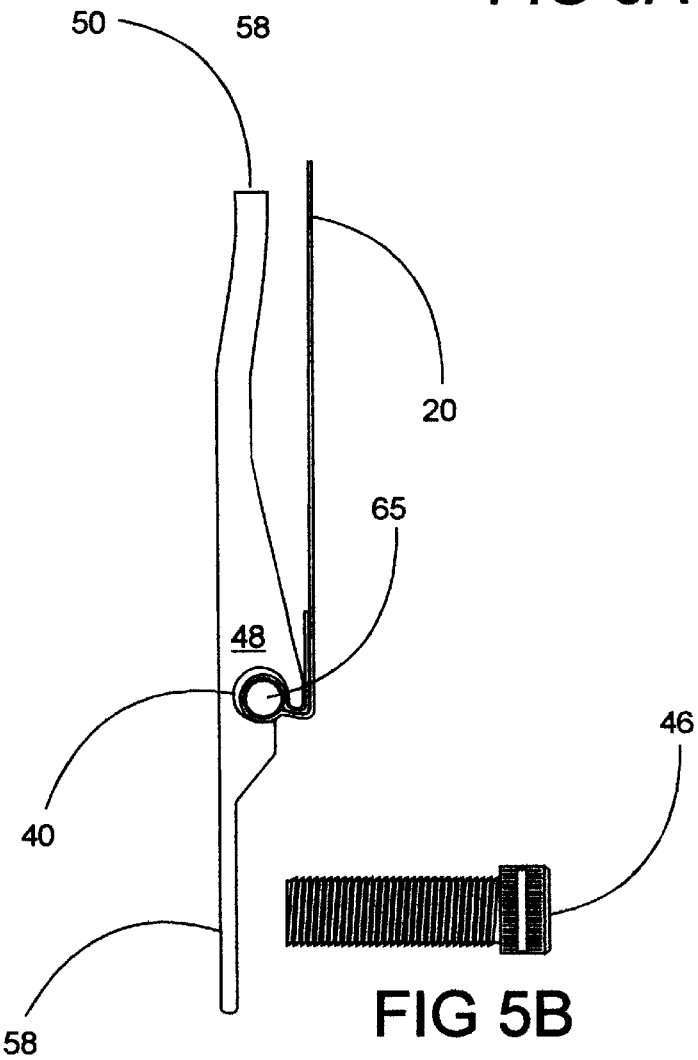
FIG. 5B is a sectional view taken along the section line 5B of FIG. 5A.

FIGS. 5A and 5B shows a corresponding detailed perspective view of the crossover latch rail, used, in conjunction with the anchor rail, to attach the bottom and trailing edges of the sign. The pivot slot of the anchor rail (FIGS. 4) receives the pivot edge 50 of the crossover rail 48. When fully tensioned, the crossover rail lies in a vertical plane, parallel to the plane of the vehicle or billboard wall. Thus the sign 20 is also insured to be planar, which is the optimal three-dimensional orientation of the sign for maximum readability and minimum distortion. The groove 40 of the crossover rail, which holds the sign, which is held therein by the bolt rope 65, sitting in the pocket of the sign and RF or thermally welded therein. The entire crossover latch rail 48 is attached to the substrate via the slotted holes 56, through which are fed screws 46, and screwed into the threaded screw seats. The screws 46 have a 360 degree sealing and locking pad about the middle of the thread length to seal out moisture and prevent loosening due to vibration The slotted holes allow the screw to be fastened at a variety of points of orientation of the crossover latch rail, allowing for tension adjustibility.

Figure 6A:
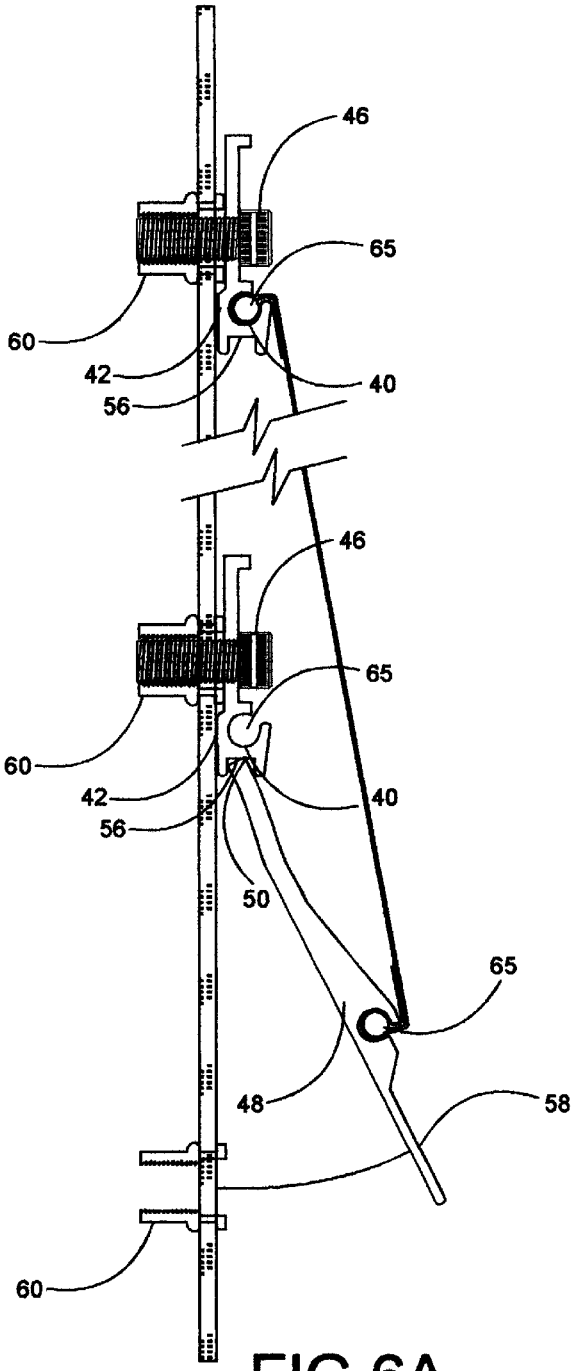
FIG. 6A is a condensed side view of the signage in the frame, showing the top and bottom rails, with the crossover latch in the open position.
Figure 6B:
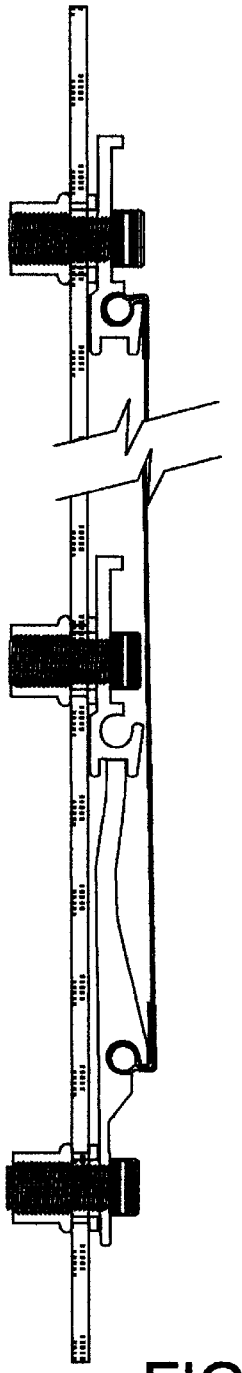
FIG. 6B is a condensed side view of the signage in the frame, showing the top and bottom rails, with the crossover latch in the closed position.
Figure 6C:
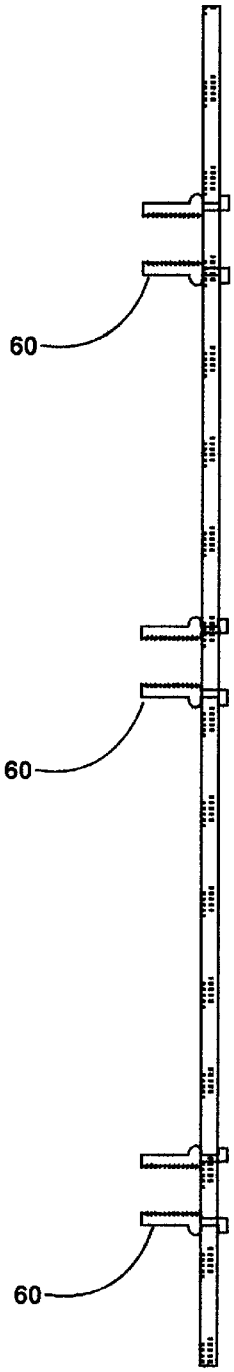
FIG. 6C is a condensed side view of the substrate wall with the frame and sign removed, showing the threaded screw seats into which the rails are screwed, where the substrate is a metallic wall.
Figure 6D:
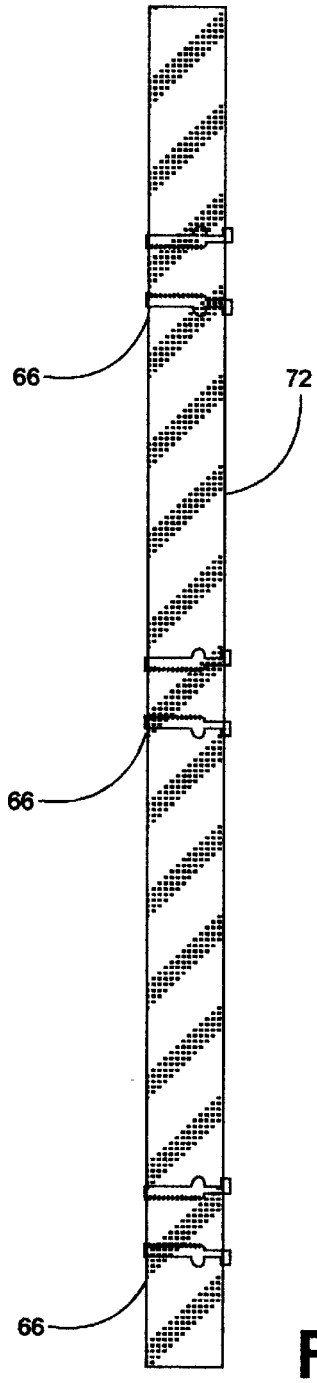
FIG. 6D is a condensed side view of the substrate wall with the frame and sign removed, showing the wood screw threaded screw seats into which the rails are screwed, where the substrate is a wooden panel.
Figure 7C:
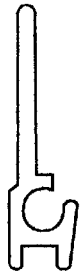
FIGS. 7C and 7D are end views of FIGS. 7A and 7B, respectively.
Figure 7A:
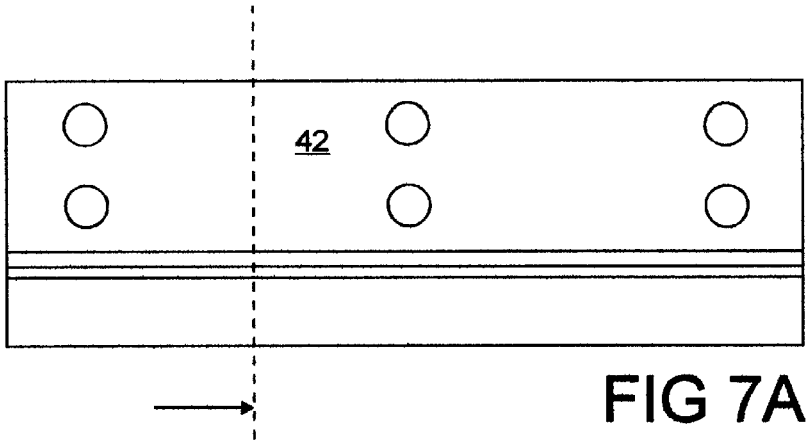
FIGS. 7A and 7B are close-up views of the anchor rail/crossover latch rail combination, showing the two rows of holes into which the screws attaching the top anchor rail to the substrate can be fed, and the slots in the bottom crossover latch all allowing for the vertical and lateral adjustability.
Figure 7D:
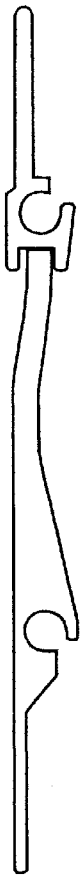
Figure 7B:
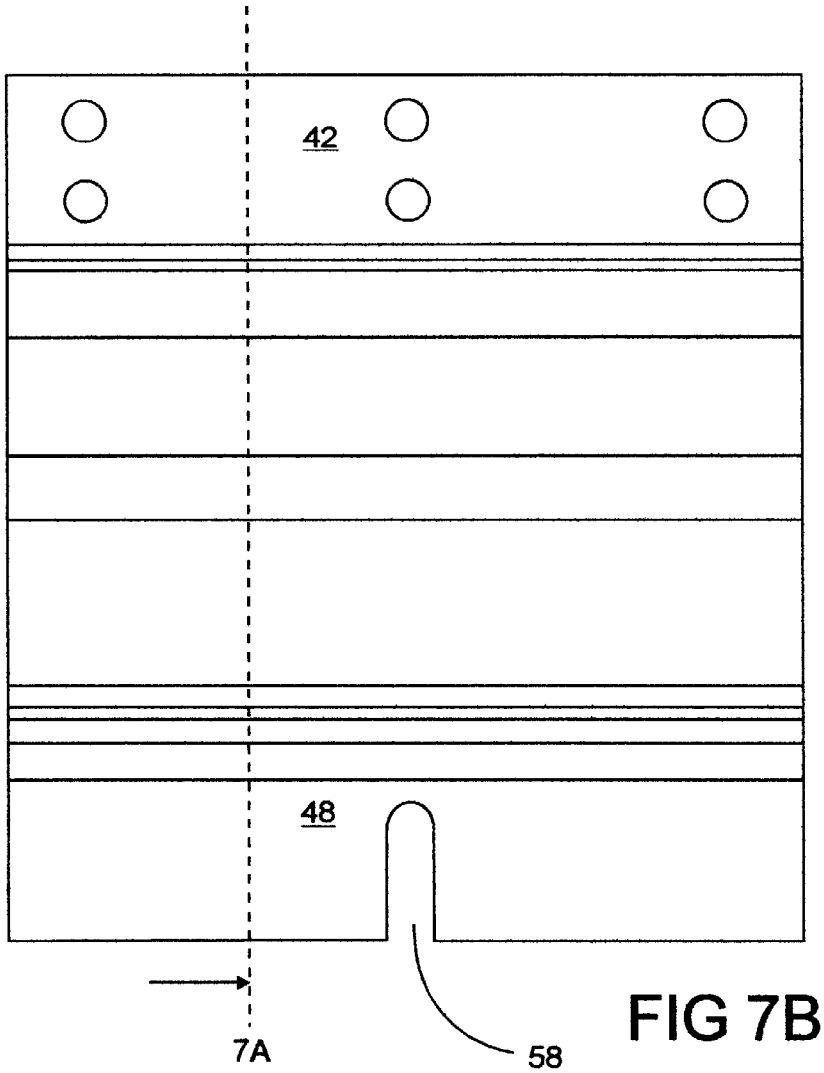

FIG. 6A and 6B show the sign 20 in the nontensioned and tensioned states, as well as the minimal and low footprint hardware residue after the removable frame has been taken down, which is simply the threaded screw seats 60 (FIG. 6C) sitting in three parallel rows along the length of the vehicle or billboard, one on top for the anchor rail 42, and two along the bottom for the anchor rail 42 and cross-over rail 48 combination, and then one row of fixed fasteners along the leading edge and two rows along the trailing edge. FIG. 6D is identical to FIG. 6C except that the shown substrate is a wood panel, for wood paneled transport vehicle implementations or fixed billboard implementations.

FIG. 6A affords a view as well of the entire framing system operating as a whole. The signage or display is held on the top and leading edges by the anchor rail 42, and on the bottom and trailing edges by the bottom and trailing edges of the crossover latch rail 48. The pivot edge 50 of the cross-over rail is set into the pivot slot 56 found on the bottom or trailing edge of the anchor rail 42, and the groove 40 of the cross-over latch rail 48 is where the sign is inserted, and said cross-over latch rail is attached to the substrate, either metal or wood vehicle wall, or wood billboard, by feeding the screws through the slotted holes 58. The screw go into the threaded screw seats 60, or the wood threaded screw seats 66, depending upon the implementation.

Finally, FIG. 7 shows a length-view close-up of the anchoring and tensioning mechanisms, respectively, used along the top and leading, as well as trailing and bottom, edges of the signage frame, respectively. Note that the slotted holes 58 on the bottom and trailing edges are spaced much farther apart than are the holes within the two rows of screw holes 44 which facilitate the fastening of the anchor rails 42, in an attempt to minimize the impact on the transport vehicle. The screw holes chosen will depend on the exact size of the sign being inserted in the frame, which will depend on manufacturing variations in the sign material itself. The bottom and trailing edges of the sign are held by the cross-over rails 48, which are held in place on one edge by the identical anchor rails 42 as are used for the top and leading edges of the frame, and on the other edge by slotted holes 58, which allow for varying the positions where the cross-over rail is attached to the wall of the vehicle or billboard, allowing for tension adjustability.

An alternative embodiment which is contemplated, and fully within the scope of the invention, is the affixation of the sign to a groove insertion strip, along the sign perimeter by means of thermal or RF welding, and thus inserting the sign into the frame grooves by this mechanism.

Figure 8A:
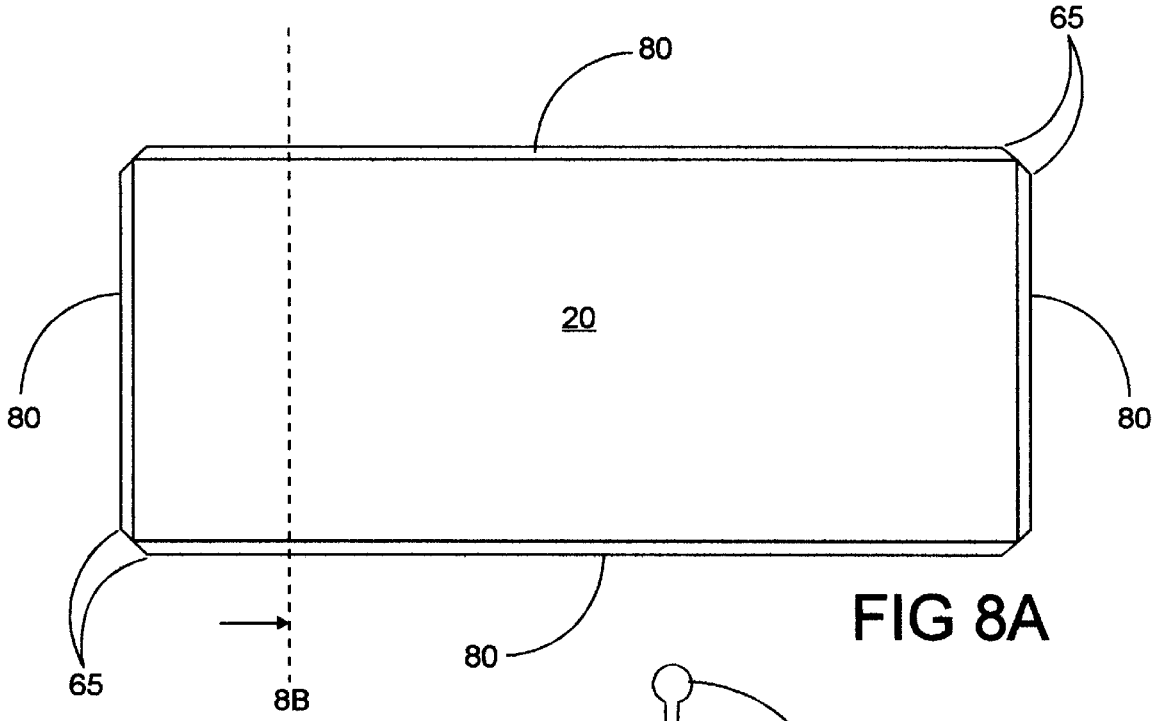
FIG. 8 shows a different embodiment of the invention, using a strong yet flexible PVC groove insertion strip RF welded to the signage; the groove insertion strip fits into the frame groove, and thus holds the sign in place.
Figure 8C:
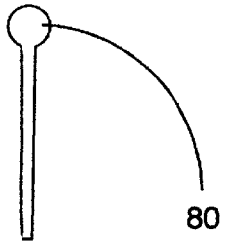
Figure 8B:
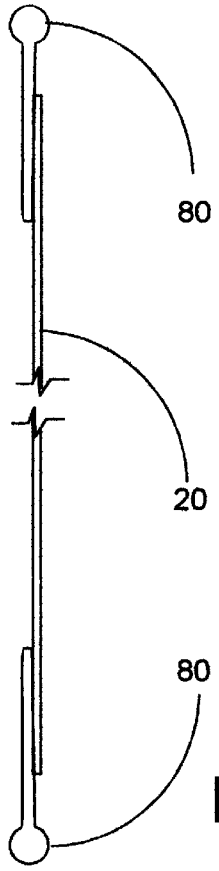

FIG. 8C shows a keyhole-shaped PVC groove insertion strip 80, in isolation, and FIG. 8B shows it as attached to the sign 20, in cross section. The cross section is taken from FIG. 8A, showing the view from behind the sign, indicating where the groove insertion strip attaches to the signage 20. The embodiment of the invention may be preferable, depending on the relative manufacturing costs and tolerances, to the bolt rope in the sign pocket method. As in the bolt rope method, RF welding is used to affix the strip portion of the insertion strip to the back of the sign.

In one optional embodiment of insertion strip 80, the strip may include a thin, flexible longitudinal strip portion designed to lay flat against a marginal portion of the sign 20, shown in FIG. 8B. An enlarged bead extends along the outer edge of the strip portion. As shown in FIG. 8B, the bead is spaced slightly away from the adjacent edge of the sign 20. The bead may be in circular, oval, or similar shape, with the diameter/width of the bead closely corresponding to the diameter (slightly smaller) of groove 40 formed in anchor rail 42 and latch rail 48. As such, the bead may be slideably engageable within groove 40, but once positioned within the groove the bead is held captive within the groove, because the width of the opening to the groove is narrower than the diameter/width of the bead.

The insertion strip 80 can be formed as a singular member from PVC or similar material. As such, it is possible to form the strip 80 economically by use of a continuous extrusion die. Also, if need be, the bead can be reinforced, for instance by cable or rope (composed of braided wire, graphite or other high-strength material) extending through the center of the bead. However, applicant anticipates that in most situations such reinforcement will not be required.

As noted above, the strip portion of the insertion strip is securely attached in overlapping fashion to the adjacent edge portion of the sign 20. One preferred way of accomplishing this attachment is through RF welding Of course, other well-known attachment methods may be used, for instance by gluing, stitching, riveting, etc.

Additionally, the invention contemplates variable spacing of the top and bottom, as well as the front and trailing frame rails, within certain tolerances, by allowing the anchor rails to be affixed to the substrate at various positions within a certain rectangular envelope, all using the same embedded screw seats in the substrate, so as to support variations in sign size, and to additionally support the adjustment of the tension on the signage material.

The invention can be enhanced as concerns the adjustability of the distance between the top and bottom or front and trailing, frame rails, if desired, by replacing the two rows of screw holes, which facilitate the fastening of the anchor rails (screw holes: 44 in FIG. 7) with a rectangular slot. FIG. 9B shows the anchor rail 42, with the rectangular slots 82 cut into it. Additionally, the slotted holes (58 in FIG. 7) have been replaced with the identical rectangular slots 82 as have been cut into the anchor rails. This configuration thus allows distance adjustability within the range of 2W, where W is the height of the rectangular slot. One way to constrain the adjustability within the ±2W range is shown in FIG. 10A and 10B. FIG. 10B shows the head on view of the slots in the anchor and crossover rails, and in the top drawing of FIG. 10B a cam washer 84 is shown fitted over the rectangular slot 82. This cam washer, by means of which way it is oriented rotationally over the rectangular slot 82, is capable of spacing the anchor rail at various discrete positions relative to the fixed embedded screw seat in the substrate, within the ±W is distance envelope. In this embodiment (also depicted in FIG. 9A) the anchor rail is recessed slightly where the cam washer 84 sits in it, as shown in the cross sectional side view shown in FIG. 10A.

FIG. 10A shows the two extreme positions of the screw 46 within the range of adjustability, on the bottom, or trailing, anchor rail and cross-over rail combination. The position of the frame is obviously set by the orientation of the cam washer 84 in the anchor rail at the top. The positioning of the screw 46 affixing the cross-over rail to the substrate is then determined, and it is screwed in over a simple flat washer 86. The simple flat washer 86 is used due to the potentially greater width of the rectangular slot 82 relative to the width of the head of the screw 46.

A veritable infinite set of modifications and adaptations to the above-described embodiment will be apparent to anyone skilled in the art as falling within the scope of the invention. Thus, the scope of the invention is not to be considered as limited by the above-described embodiments but, rather, determined by reference to the claims that follow.

The embodiments of the invention in which an exclusive property or privilege is claimed are defined as follows:

1. A signage display system mountable on an outer surface of a substrate for supporting a sign having a first end portion and an opposite end portion spaced from the first end portion and having a width, the signage display system comprising:

a first external attachment mechanism configured to be mountable on an outer surface of a substrate and slidably attachable to a first edge portion of a sign;

a first external over-center lever mechanism pivotable about a pivot end mountable on an outer surface of a substrate at a location spaced from the first external attachment mechanism and slidably attachable at an attachment location to an opposite edge portion of a sign between the pivot end and an opposite end of the first external over-center lever mechanism, whereby a first and opposite edge portions of a sign can be attached to the first attachment mechanism and the attachment location of the first external over-center lever mechanism, respectively, and the first lever mechanism can be pivoted about the pivot end until the first lever mechanism is in over-center position and substantially flat against the exterior of a substrate and until a sign that is within the signage display system is consistently tensioned in place completely externally to an outer surface of a substrate, and the first over-center lever mechanism can be mounted completely externally to an outer surface of a substrate to which the signage display system is mountable;

further comprising a cam washer having an aperture formed therein at a location asymmetrical relative to the shape of the cam washer;

at least one of the first attachment mechanism and first lever mechanism having a seat for receiving the cam washer, the seat being shaped to allow the cam washer to be positioned within the seat to enable the position of the aperture of the cam washer to be selectively changed relative to the seat; and at least one of the first attachment mechanism and first lever mechanism being mountable to a substrate by a fastener extending through the aperture of the cam washer.

2. A signage display system for attaching to an outer surface of a substrate, the signage display system comprising:

a flexible sign having a width;

a first external attachment mechanism configured to be mountable on an outer surface of a substrate and consistently receive one edge of the sign;

a first external lever mechanism pivotable about a pivot end mountable on an outer surface of a substrate and attachable at an attachment location to an opposite edge of the sign between the pivot end and an opposite end of the first lever mechanism, whereby opposite edges of the sign can be attached to the first attachment mechanism and the attachment location of the first lever mechanism, and the first lever mechanism can be pivoted about the pivot end until the sign that is within the signage display system is consistently tensioned in place completely externally to an outer surface of a substrate to which the signage display system can be attached;

further comprising a cam washer having an aperture formed therein at a location offset relative to the external shape of the cam washer;

at least one of the first attachment mechanism and first lever mechanism having a seat for receiving the cam washer, the seat being shaped to enable the cam washer to be selectively positioned within the seat so that the aperture of the cam washer can be selectively changed relative to the seat; and at least one of the first attachment mechanism and first lever mechanism being mountable to a substrate by a fastener engaged through the aperture of the cam washer.

3. A signage display system mountable on an outer surface of a vehicle, the signage display system comprising:

a. a flexible sign having a first edge portion, the first edge portion of the sign devoid of a bead portion;

b. a first insertion strip constructed independently of the sign and attached to the first edge portion of the sign, said first insertion strip comprising a first longitudinal strip portion secured to the first edge portion of the sign, and a first bead portion extending along the first longitudinal strip portion, said first bead portion positioned outward of he first edge portion of the sign so as not to overlap the first end portion of the sign;

c. wherein the first longitudinal strip portion and the first bead portion are of unitary construction;

d. a first external attachment mechanism configured to be mountable on an outer surface of a vehicle;

e. a first tensioning mechanism positionable on an outer surface of a vehicle, the first tensioning mechanism operable between a retracted position to allow slack in the sign between the first external attachmnent mechanism and the first tensioning mechanism, and a tensioned position wherein the sign is consistently tensionable in place externally of and closely adjacent to an outer surface of a vehicle;

f. wherein one of the first external attachment mechanism and the first tensioning mechanism having portions defining a first groove sized and configured to slidably receive the first bead portion of said first insertion strip and retain the first bead portion once the first bead portion is engaged within the first groove; and g. the other of the first external attachment mechanism and the first tensioning mechanism fastenable to the sign at a location spaced from the first bead portion of said first insertion strip.

4. The signage display system of claim 3, wherein the first longitudinal strip portion overlaps the first edge portion of the flexible sign.

5. The signage display system of claim 3:

a. wherein the flexible sign comprising a second edge portion at a location opposed to the location of the first edge portion of the sign, the second edge portion of the sign being devoid of a bead portion;

b. further comprising a second insertion strip structurally independent from the flexible sign, comprising a second longitudinal strip portion fastenable to the second edge portion of the flexible sign and a second bead portion extending along the outer edge of the second longitudinal strip portion; and c. the other of the first external attachment mechanism and the first tensioning mechanism, having portions defining a second groove sized and configured for slidably receiving the second bead portion and retaining the second bead portion once the second bead portion is engaged within the second groove.

6. The signage display system of claim 5, wherein the first and second longitudinal strip portions overlap the first and second edge portions, respectively, of the flexible sign.

7. The signage display system of claim 6, wherein the first and second longitudinal strip portions being of unitary construction and of unitary material composition with the respective first and second bead portions.

8. The signage display system of claim 7, wherein the first and second longitudinal strip portions and the first and second bead portions are composed of plastic material.

9. The signage display system of claim 8, wherein the first and second bead portions are composed of solid plastic material.

10. The sign display system of claim 5:

a. wherein the flexible sign having a third edge portion, b. further comprising a third insertion strip manufactured structurally independent from the flexible sign, the third insertion strip comprising a third longitudinal strip portion fastenable to a third edge portion of the flexible sign and a third bead portion extending along the third edge portion, c. further comprising a second external attachment mechanism configured to be mountable on an outer surface of a vehicle;

d. further comprising a second tensioning mechanism positionable on an outer surface of a vehicle, the second tensioning mechanism operable between a retracted position to allow slack in the sign between the second external attachment mechanism and a second tensioning mechanism, and a tensioned position wherein the sign is consistently tensioned in place externally to a vehicle between the second external attachment mechanism and the second tensioning mechanism;

e. wherein one of the second external attachment mechanism and the second tensioning mechanism having portions defining a third groove sized and configured for slidably receiving the third bead portion and retaining the third bead portion once the third bead portion is engaged within the third groove; and f. the other of the second external attachment mechanism and the second tensioning mechanism fastenable to the sign at a location spaced from the third bead portion.

11. The sign display system of claim 10, wherein:

a. the flexible sign having a fourth edge portion;

b. further comprising a fourth insertion strip manufactured structurally independent from the flexible sign, comprising a fourth longitudinal strip portion fastenable to the fourth edge portion of the flexible sign, and a fourth bead portion extending along the fourth edge portion; and c. the other of the second external attachment mechanism and the second tensioning mechanism having portions defining a fourth groove sized and configured for slidably receiving the fourth bead portion therein and retaining the fourth bead portion once the fourth bead portion is engaged within the fourth groove.

12. The signage display system of claim 3, wherein the first tensioning mechanism comprising a first lever pivotable about a pivot portion on an outer surface of a vehicle, the first lever having portions defining the first groove and attachable at an attachment location to the first bead portion, whereby the first lever can be pivoted about the pivot portion until the sign is consistently tensioned in place externally and closely adjacent to an outer surface of a vehicle and the first lever is externally closely overlying of an outer surface of a vehicle to which the signage display system is attached.

13. The signage display system of claim 12, wherein the first groove is integrally constructed with the first lever.

14. The signage display system of claim 3, wherein the first tensioning mechanism is an over-center tensioning mechanism shiftable between an untensioned position and a tensioned position wherein the first tensioning mechanism is in over-center position that consistently tensions the sign, and wherein when the over-center tensioning mechanism is in tensioned position, the first tensioning mechanism extends substantially flat against a vehicle to which the signage display system is mounted so that the first tensioning mechanism is external of an outer surface of a vehicle and does not extend substantially beyond the position of the sign in the direction away from a vehicle.

15. The signage display system of claim 3, wherein the first longitudinal strip portion and the first bead portion are both comprised of plastic material.

16. The signage display system of claim 15, wherein the first bead portion is composed of solid plastic material.

17. The signage display system of claim 3, wherein the first longitudinal strip portion of the first insertion strip is composed of flexible, planar material.

18. A signage display system mountable on an outer surface of a vehicle, the signage display system comprising:

a. a flexible sign having a perimeter portion;

b. an insertion strip constructed independently of the sign and attached to the perimeter of the sign, said insertion strip comprising a longitudinal strip portion secured to the perimeter portion of the sign using an attachment method selected from the group consisting of stitching, using an adhesive, fusion under heat, using a hardware fastener, bonding, and riveting, and a bead portion extending along the longitudinal strip portion, the entirety of said bead portion positioned outwardly of the perimeter portion of the sign;

c. wherein the longitudinal strip portion and the bead portion are of unitary construction;

d. a first external attachment mechanism configured to be mountable on an outer surface of a vehicle;

e. a first tensioning mechanism positionable on an outer surface of a vehicle, the first tensioning mechanism operable between a retracted position to allow slack in the sign between the first external attachment mechanism and the first tensioning mechanism, and a tensioned position wherein the sign is consistently tensionable in place externally of and closely adjacent to an outer surface of a vehicle;

f. wherein one of the first external attachment mechanism and the first tensioning mechanism having portions defining a first groove sized and configured to slidably receive the first bead portion of said insertion strip and retain the bead portion once the bead portion is engaged within the first groove; and g. the other of the first external attachment mechanism and the first tensioning mechanism fastenable to the sign at a location spaced from the bead portion of said insertion strip.

* * * * *

UNITED STATES PATENT AND TRADEMARK OFFICE

CERTIFICATE OF CORRECTION

PATENT NO. : 6,250,002
DATED : October 5, 1993
INVENTOR(S) : R.L. Wittenberg

It is certified that error appears in the above-identified patent and that said Letters Patent is hereby corrected as shown below:

Column 10,
Line 11, "outward of he" should read -- outward of the --
Line 19, "attachmnent" should read -- attachment --

Signed and Sealed this

Fifth Day of March, 2002

*Attest:*

*Attesting Officer*

JAMES E. ROGAN
*Director of the United States Patent and Trademark Office*